United States Patent [19]

Igarashi

[11] Patent Number: 4,838,806

[45] Date of Patent: Jun. 13, 1989

[54] ELECTRICAL CONNECTOR

[75] Inventor: Masazumi Igarashi, Atsugi, Japan

[73] Assignee: Molex Incorporated, Lisle, Ill.

[21] Appl. No.: 149,996

[22] Filed: Jan. 26, 1988

Related U.S. Application Data

[63] Continuation of Ser. No. 42,930, Apr. 27, 1987, abandoned.

[30] Foreign Application Priority Data

Feb. 5, 1986 [JP] Japan ..... 61-67469[U]

[51] Int. Cl.[4] ..... H01R 9/09

[52] U.S. Cl. ..... 439/341; 439/376

[58] Field of Search ..... 439/259–261, 439/326, 338, 341–343, 374, 376, 377, 409, 410

[56] References Cited

U.S. PATENT DOCUMENTS

| | | | |
|---|---|---|---|
| 3,920,303 | 11/1975 | Pittman et al. | 439/326 |
| 4,136,917 | 1/1979 | Then et al. | 439/326 |
| 4,341,430 | 7/1982 | Crawford | 439/409 |
| 4,575,172 | 3/1986 | Walse et al. | 439/326 |
| 4,636,022 | 1/1987 | Sonobe | 439/326 |

*Primary Examiner*—Gary F. Paumen

*Attorney, Agent, or Firm*—John W. Cornell; Louis A. Hecht

[57] ABSTRACT

An improved plug-and-receptacle electric connector arrangement designed such that in mating the plug connector and the receptacle connector, the plug connector is inserted at an angle within the receptacle connector until the front end of the plug has reached the rear end of the entry space of the receptacle connector. The plug connector is rotated about a fixed point of the receptacle connector until the plug connector has been put in alignment with the receptacle connector. Then, both mechanical and electrical connections are established between the mating units.

3 Claims, 6 Drawing Sheets

ELECTRICAL CONNECTOR

This application is a continuation of application Ser. No. 042,930 filed Apr. 27, 1987, now abandoned.

BACKGROUND OF THE INVENTION

1. Field of the Invention

This invention relates to a low insertion force electric connector arrangement including a plug connector and a receptacle connector designed to be mated to each other by inserting the plug connector in the receptacle connector and subsequently rotating the plug connector within the receptacle connector.

2. Brief Description of the Prior Art

In a conventional electric connector arrangement including of plug and receptacle connectors, the plug and receptacle can be coupled to each other simply by inserting and sliding the male unit straight into the female unit. This type of electric connector arrangement has some defects.

In use, the prior art plug connector is inserted into the receptacle connector until the front end of the plug connector has reached the rear end of the opening or entry space of the receptacle connector. After the plug is fully inserted, the terminals of the plug connector are engaged with the terminals of the receptacle connector. This type of mating motion makes it somewhat difficult to confirm that the plug connector has been inserted in the receptacle connector deep enough to make good electrical connection. In other words, there is the possibility of an incomplete insertion wherein the terminals of the plug connector do not contact those of the receptacle connector causing a failure to establish electrical connection between the two mating electrical connectors. It is difficult to discern an incomplete engagement because the appearance of the mating terminals is hidden from view.

SUMMARY OF THE INVENTION

The principal object of this invention is to provide an improved electric connector arrangement including a plug connector and a receptacle connector which permits detection of an incomplete mating by observing the mated connectors which facilitates checking and maintenance. To attain this object, an electric connector arrangement made according to this invention is so designed that: the plug connector is inserted into the receptacle connection in an angled direction and is rotated about a fixed point of the receptacle connector so that the plug connector is pushed against the rear end of the plug opening of the receptacle connector. This ensures that the terminals of the plug connector are in good electrical contact with the terminals of the receptacle connector, and, at the same time, makes it easy to decide whether the electrical connection is complete or not, simply by observing the mated connectors.

BRIEF DESCRIPTION OF THE DRAWINGS

The above object and advantages of this invention will be understood from the following description of a preferred embodiment, which is shown in accompanying drawings.

DESCRIPTION OF THE PREFERRED EMBODIMENT

Figure 1:
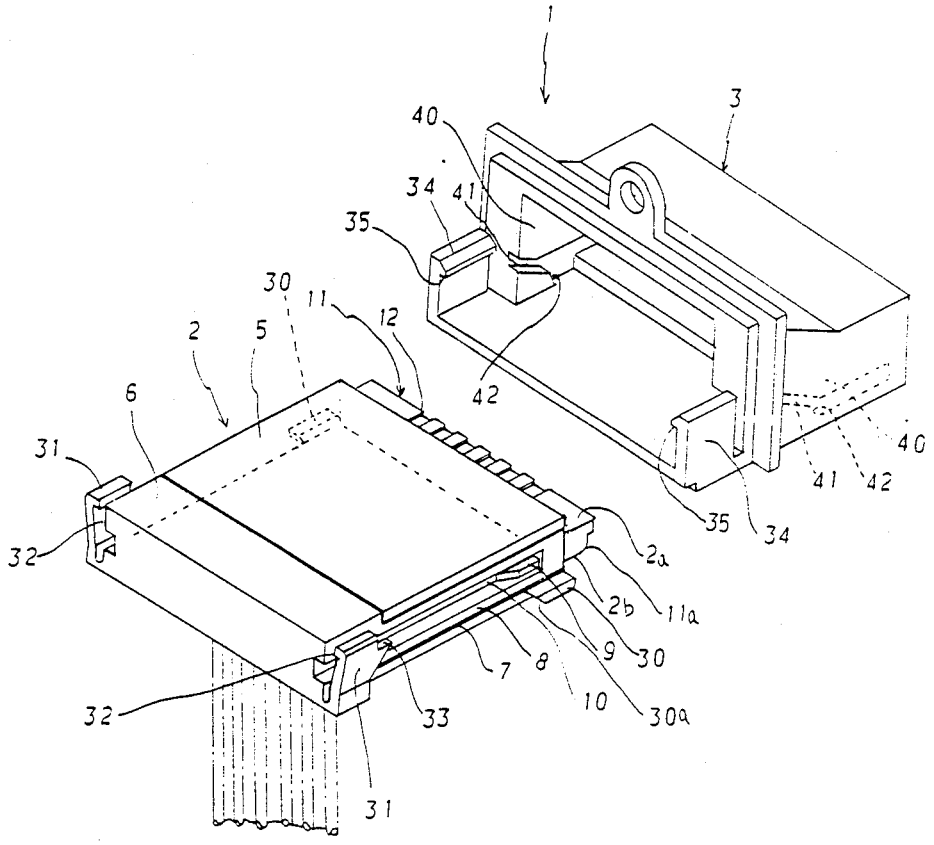
FIG. 1 is a perspective view of a plug connector and a receptacle connector comprising the connector arrangement of this invention, prior to mating.

Referring to the drawings, an electric connector arrangement, generally designated 1, is shown as comprising a plug connector 2 and a mating receptacle connector 3, which are used in connecting ribbon cable 18 to an input/output apparatus 4.

Looking at FIG. 1, plug connector 2 is composed of a plug body 5 and a plug cover 6. A latch slot 7 is made in each side of the plug body 5, and a latch piece 8 is integrally connected to each side of the front end of the plug cover 6. The plug cover 6 is applied to the plug body 5 from behind. In a latched position, a latch projection 9 projects from the latch slot 7 to fit in a latch hole 10, which is made in the latch piece 8.

As best shown in FIG. 1, the upper and lower surfaces **2*a* and 2*b* of front end 11 of the plug connector 2 have a plurality of parallel opposing pairs of terminal receiving slots 12 at regular intervals, for instance, of 2.5 mm. A corresponding plurality of plug terminals 13 are fitted in these parallel slots 12. The slots 12, may be omitted, and then the upper and lower terminal portions may be mounted on the upper and lower flat surface 2*a* and 2*b* of the front end of the plug connector 2**.

Figure 3:
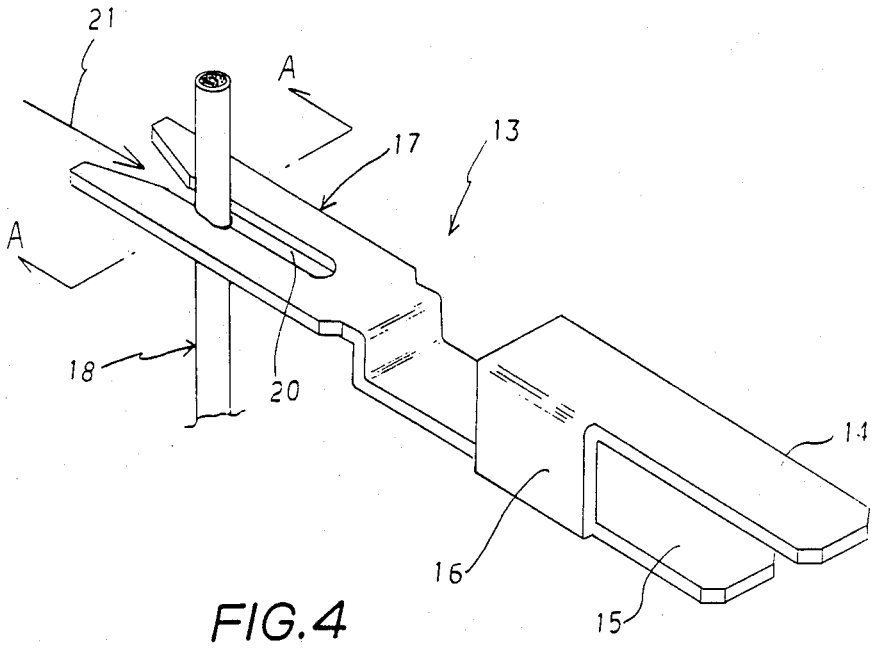
FIG. 3 is a perspective view of a plug terminal engaged to an insulated conductor.
Figure 4:
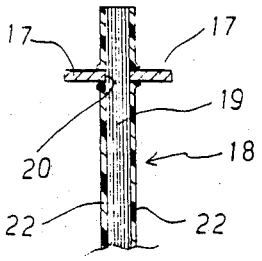
FIG. 4 is sectional view of the plug terminal taken along the line A—A in FIG. 3.

A long upper and a shorter lower forward portions or extensions 14 and 15 of each plug terminal (FIG. 3) are fitted in associated upper and lower slot pairs 12. The plug terminal 13 also includes a cross piece 16 integrally connecting the upper and lower extensions 14 and 15, and a slotted insulation displacement (ID) portion 17 extending from the lower forward extension 15.

Each plug terminal 13, when mounted in the plug body 5, will have its ID portion 17 exposed outward from the rear end **5*a* of the plug body 5. When a single insulated wire 18 is pushed in the longitudinal slot 20 of the ID portion 17 in the direction indicated by arrow 21, the insulation 22 of the wire 18 is cut and stripped, thereby causing the ID portion 17 to be in contact with the conductor core 19 of the insulated wire 18**.

The receptacle terminals 23 are arranged at the same intervals as the plug terminals, 13 and are fixed on the rear end of the entry space 24 of the receptacle connector 3. In this embodiment, there are six plug terminals 13 and six receptacle terminals 23.

Figure 2:
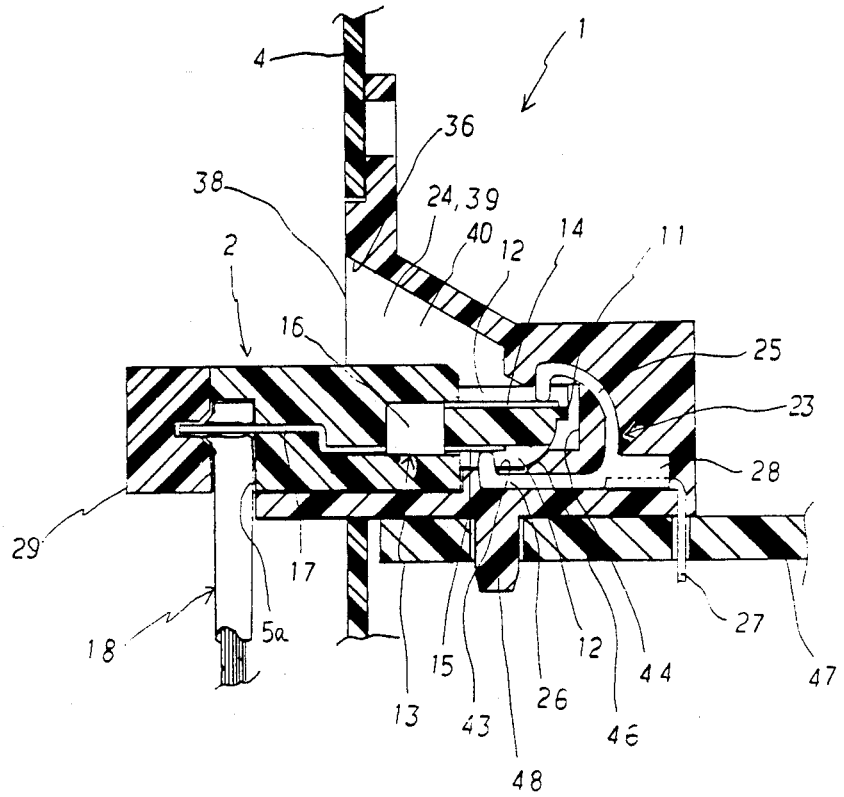
FIG. 2 is a side sectional view of the mated connector arrangement of FIG. 1.
Figure 5:
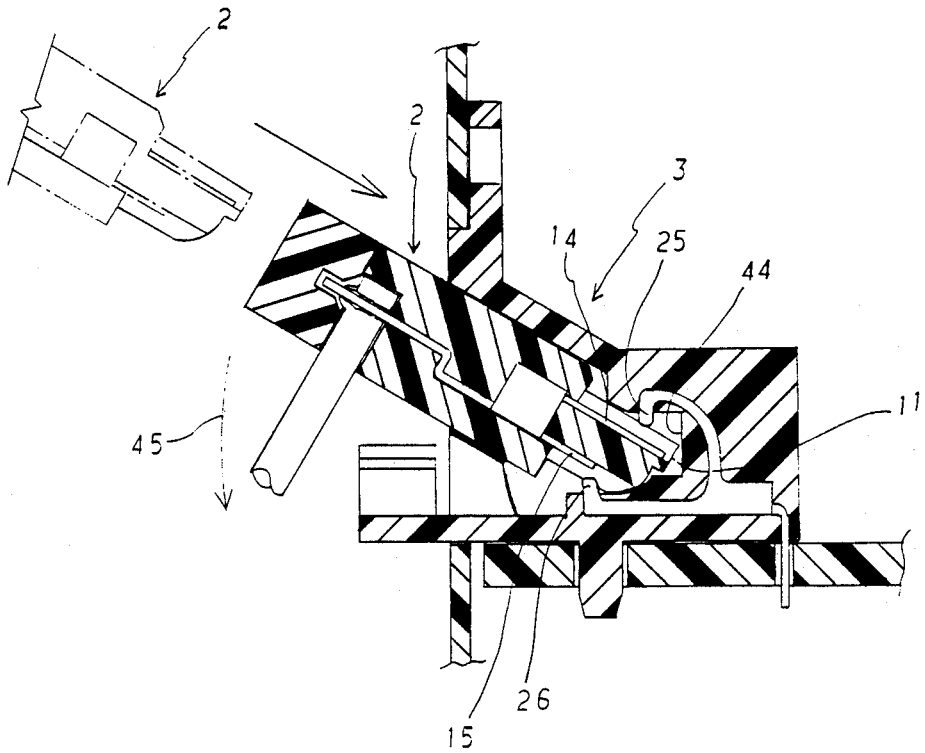
FIG. 5 is a sectional view of the connector arrangement of the present invention with the plug connector inserted in an angled non-mating relationship with the receptacle connector.

Looking at FIGS. 2 and 5, each receptacle terminal 23 is generally C-shaped comprising an upper portion 25, a generally flat lower portion 26, a solder tail portion 27 and a joint portion 28 integrally connecting the other portions 25, 26 and 27 together. As is shown in FIG. 2, the upper portion 25 of the receptacle terminal 23 rises along the end or rear wall and it extends along the ceiling of the entry space 24. The lower portion 26 extends along the floor of the entry space. The joint portion 28 extends along the floor opposite to the lower portion 26. The solder tail 27 extends down from the receptacle body to provide a lead terminal for a connection to circuitry on a printed circuit board 47.

A lock projection 30 is integrally connected to each side of the plug at a position extending from the front end 11 towards the rear end 29 of the plug body and situated at a lower level. A resilient catch piece 31 is integrally connected to each side of the rear end of the plug body 5. Each lock piece 30 has a rounded front end and a tapered rear end. The rounded front end of the lock piece facilitates the push-in of the lock piece in the guide slot. Each catch piece 31 stands erect on each side of the rear end of the plug cover 6, and is made resilient.

There is a space 32 between the catch piece 31 and the plug cover 6 to permit the catch piece to yieldingly bend backward in the course of latching. The catch piece 31 is resilient so that it automatically returns to its original position after it has been unlatched.

Each catch piece 31 has a cooperating interengaging snaplock 33 integrally connected to the upper front edge of the catch piece 31. When the plug connector 2 is inserted at an angle and is rotated within the receptacle connector 3 for alignment, each catch piece 31 is put in engagement with the corresponding hold piece 35.

As shown in the drawings, the entry space 24 is defined by a ceiling 36. opposite side walls 40 and floor 43 of the receptacle body. The ceiling 36 of the entry space 24 is slanted to permit the angled insertion of the plug connector 2. Each of the opposite walls 4 has a slant slot 41 for guiding the angled insertion of the plug connector 2 in the entry space. A catch recess 42 is provided between the terminal end of each slant slot 41 and the floor 43.

Figure 6:
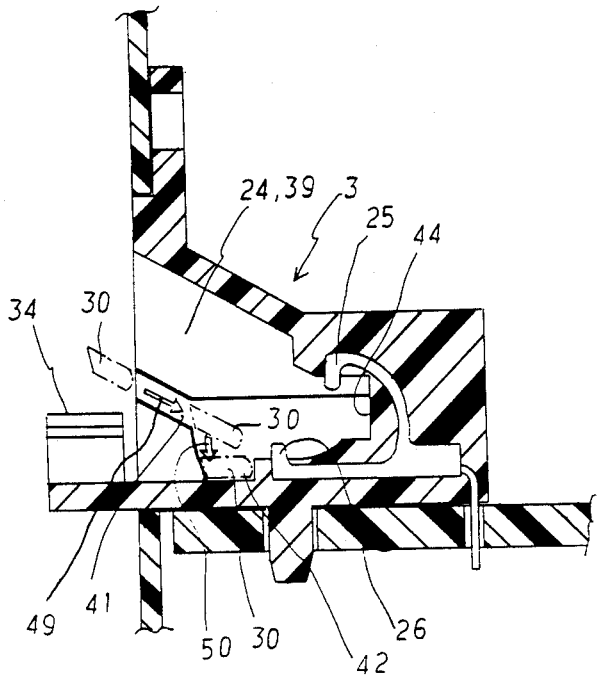
FIG. 6 is a sectional view similar to FIG. 5 showing how the mating connectors mechanically cooperate with each other when the plug connector is inserted in the receptacle connector.
Figure 7:
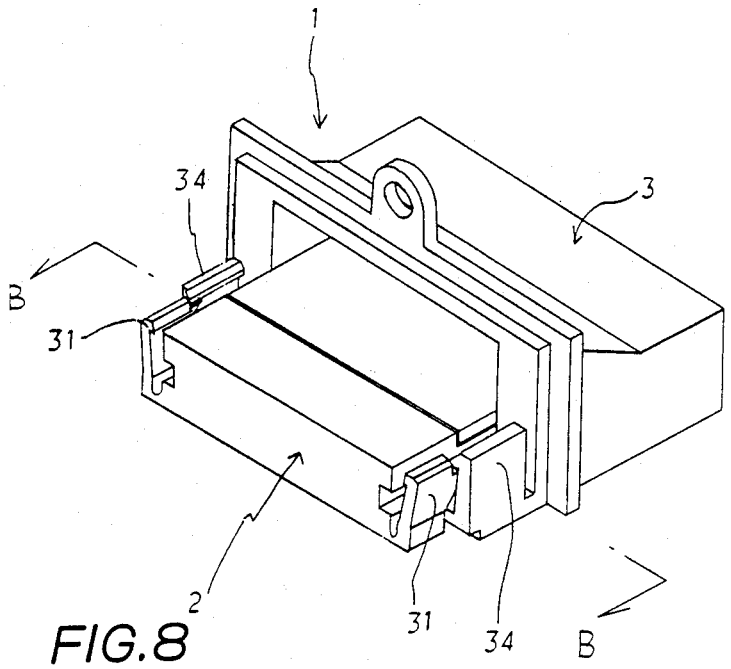
FIG. 7 is a perspective view of the connector arrangement of the present invention in a mated configuration.
Figure 8:
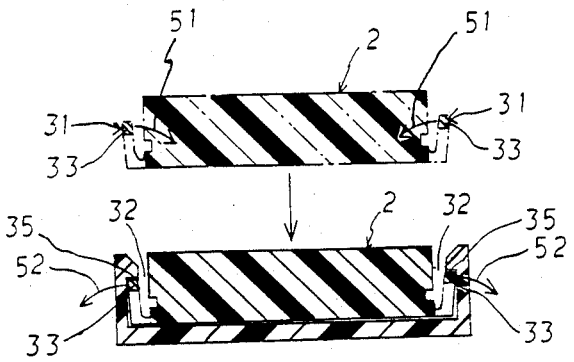
FIG. 8 is a sectional view of the connector arrangement of the present invention taken along the line B—B in FIG. 7.

Looking at FIG. 5, the plug connector 2 is inserted at an angle in the entry space 24 until the front end 11 of the plug connector 2 has reached the rear end 44 of the entry space. Then, the catch recesses 42 (FIG. 6) permit the plug connector 2 to rotate about a fixed point of the receptacle connector 3. Once the lock pieces 30 have fitted in the catch recesses 42, the plug connector 2 cannot disengage from the receptacle connector 3 in the horizontal direction. A curved surface 46 which extends from the rear end 44 to the floor 43 of the entry space 24 of the receptacle connector 3, is effective to guide the rounded edge 11*a* of the front end 11 of the plug connector 2, and permit the smooth rotation of the plug connector 2 with respect to the receptacle connector 3.

The printed circuit board 47 is shown as constituting a part of the input/output apparatus 4. The receptacle connector 3 is fixed to the printed circuit board 47 with a mounting projection 48 pushed in a hole formed therein.

In use, the plug connector 2 is inserted at an angle within the receptacle connector 3 with the lock pieces 30 of the plug connector 2 inserted in the slant guide slots 41 of the receptacle connector 3. Because of the slant guide slots 41, the angled insertion of the plug connector 2 in the receptacle connector 3 as indicated by arrow 49 (FIG. 5) can be performed smoothly until the front end 11 of the plug 2 has reached the rear end 44 of the entry space 24 of the receptacle connector 3. Even when the insertion is completed, the plug terminal portions 14 and 15 are not brought in electrical contact with the receptacle terminal portions 25 and 26, respectively.

Subsequent to completion of the insertion of the plug connector 2 into the receptacle connector 3, the rear end 29 of the plug connector 2 is rotated within the receptacle connector 3 as indicated by arrow 45 in FIG. 5. Then, the catch recesses 42, which are continguous to the slant slots 41, guide the lock pieces 30 of the plug connector 2 in a descending fashion, as indicated by arrow 50 in FIG. 6, so that the plug connector may be smoothly rotated with respect to the receptacle connector. When the rotation is completed, the plug connector 2 is brought in alignment with the receptacle connector 3. This causes the upper portions 14 of plug terminals to contact the upper portions 25 of the receptacle terminals and the lower portions 15 of plug terminals are to contact the lower portions 26 of the receptacle terminals, as best shown in FIG. 2.

At completion of insertion-and-rotate operation, the lock pieces 30 have been caught by the catch recesses 42. This prevents the plug connector 2 from disengaging from the receptacle connector 3.

When the rotation of the plug connector 2 is completed, the resilient catch pieces 31 of the plug body are put in engagement with the hold pieces 35 of the receptacle connector 3, thereby preventing the plug connector 2 from rotating upward with respect to the receptacle connector 3. The plug connector 2 can be fastened to the receptacle connector 3 without any possibility of undesired release of the plug connector therefrom.

As may be understood from the above, in an electric connector arrangement made according to this invention the mating operation comprises the steps of an angled insertion 37 of the plug connector 2 in the receptacle connector 3 and subsequent rotation 45 of the plug connector 2 with respect to the receptacle connector 3. This latter step attains the machanical and electric connection between the plug connector 2 and the receptacle connector 3. In this situation, the plug connector is in alignment with the receptacle. If the plug should not be fully-inserted to permit rotation within the receptacle connector, no electrical connection can be established. An electric connector arrangement with its mating parts incompletely mated can be easily detected simply by observation, thus reducing such difficulty as would be previously encountered. in trying to detect defective connector engagements.

I claim:

1. An electrical connector arrangement for connection a plurality of insulated conductors to circuitry on a printed circuit board, said arrangement comprising:

a printed circuit board having a plurality of circuits defined thereon;

a receptacle connector mounted on said printed circuit board, said receptacle connector including a housing having a front end with a divergent entry space extending rearwardly from the front end into the housing for receiving a mateable plug connector, said divergent entry space being defined by a pair of opposed sidewalls, a ceiling and a floor extending to a rear wall in the housing, said entry space being further defined by a slant slot made on each sidewall, a catch recess continguous to said slant slot on each sidewall and a curved surface extending between the rear wall and the floor adjacent the rear of said entry space, said housing further including a pair of upstanding hold pieces extending from each side of the front end, said receptacle connector further including a plurality of terminals in said housing, each terminal including a generally C-shaped first contact portion having an upper portion disposed along the ceiling and a lower portion disposed along the floor of said entry space and a second contact portion extending out of the receptacle housing providing a lead terminal for connection to a circuit on a printed circuit board; and a plug connector including a plug body having a rearward end and a front end with a rounded edge , a lock piece projecting from each side of the plug body at a position extending rearwardly from the front end and situated at a lower level, and a resilient catch piece integrally connected to each side of the rearward end of the plug body and having a snap lock integrally connected to the front side of each said catch piece, said plug connector further including a plurality of terminals mounted in said plug body, each terminal having a first contact portion disposed adjacent the front end adapted to electrically engage the receptacle connector terminals and a second contact portion disposed adjacent the rearward end of the plug body including an insulation displacement contact portion; and a plurality of insulated conductors electrically engaged in the insulation displacement contact portions of said plug terminals, whereby said slants slot are effective to receive the lock pieces on the plug connector and guide the angled insertion of said plug connector in the entry space until the rounded edge of the front end of the plug connector engages the curved surface of the entry space, said curved surface and the catch recesses permitting the plug connnector to rotate within receptacle connector when the rear end of said plug connector is pushed down, and whereby upon said rotation each lock piece may engage its corresponding catch recess, and each catch piece may engage is corresponding hold piece thereby locking the plug connector and receptacle connector in mated position wherein the plug connector terminals are electrically engaged by the receptacle connector terminals.

2. A connector arrangement as in claim 1 wherein said plurality of insulated conductors are in a ribbon cable.

3. An electrical connector arrangement for connecting a plurality of insulated wire conductors to circuitry on a printed circuit board, said arrangement including:

a printed circuit board having a plurality of circuits defined thereon;

a receptacle connector mounted on said printed circuit board, said receptacle connector including a housing having a front end with a divergent entry space extending rearwardly from the front end into the housing, said divergent entry space being defined by a pair of opposed sidewalls, ceiling and a floor extending to a rear wall in the housing, said entry space being futher defined by a slant slot made on each of the sidewalls and a catch recess contiguous to said slant slot on each sidewall, said receptacle connector further including a plurality of terminals in said housing, each terminal including a generally C-shaped first contact portion having an upper portion disposed along the ceiling and a lower portion disposed along the floor of said entry space and a second contact portion extending out of the receptacle housing providing a lead terminal for connection to a circuit on the printed ciruit board; and a plurality of insulated electrical wire conductors, the improvement comprising:

a plug connector including a plug body having a rearward end, a front end and a lock piece projecting from each side of the plug body at a position extending rearwardly from the front end and situated at a lower level, said plug connector further including a plurality of terminals mounted in said plug body, each terminal having a first contact portion disposed adjacent the front end adapted to electrically engage the receptacle connector terminals and a second contact portion disposed adjacent the rearward end of the plug body adapted to electrically engage a said wire conductor, and each of said insulated wire conductors electrically engage in said second contact portions of said plug terminals, whereby said slant slots are effective to receive the lock pieces on the plug connector and guide the angled insertion of said plug connector into the entry space until the front end of the plug connector engages the rear wall of the entry space and the catch recesses permit the plug connector to rotate within the receptacle connector when the rear end of said plug connector is pushed down, and whereby upon said rotation each lock piece may engage its corresponding catch recess thereby locking the plug connector in the receptacle connector in mated position wherein the plug connector terminals are electrically engage by the

* * * * *